US006676041B1

(12) United States Patent
McLoughlin et al.

(10) Patent No.: US 6,676,041 B1
(45) Date of Patent: Jan. 13, 2004

(54) DECONTAMINATION APPARATUS

(76) Inventors: John E. McLoughlin, 3 Country La., Lake Grove, NY (US) 11755; Neocles G. Athanasiades, 6 Mayeeck Dr., E. Setauket, NY (US) 11733; Toh M. Meng, 15 Sunflower Dr., Hauppauge, NY (US) 11788

( * ) Notice: Subject to any disclaimer, the term of this patent is extended or adjusted under 35 U.S.C. 154(b) by 0 days.

(21) Appl. No.: 10/241,864

(22) Filed: Sep. 13, 2002

(51) Int. Cl.[7] ..... B05B 1/14
(52) U.S. Cl. ..... 239/565; 239/450
(58) Field of Search ..... 239/565, 450, 239/566, 568

(56) References Cited

U.S. PATENT DOCUMENTS

| | | | | | |
|---|---|---|---|---|---|
| 1,499,202 | A | * | 6/1924 | Coutu | 239/407 |
| 2,468,331 | A | * | 4/1949 | Hill et al. | 239/434.5 |
| 2,749,180 | A | * | 6/1956 | Andrews | 239/450 |
| 3,261,556 | A | * | 7/1966 | Antalik | 239/450 |
| 3,933,313 | A | * | 1/1976 | Waite | 239/273 |
| 4,095,746 | A | * | 6/1978 | Anderberg et al. | 239/754 |
| 4,448,221 | A | * | 5/1984 | Murray | 134/76 |
| 4,552,728 | A | * | 11/1985 | Taylor | 422/300 |
| 5,556,032 | A | * | 9/1996 | Varrichione | 239/279 |
| 6,042,029 | A | * | 3/2000 | Massey | 239/587.1 |
| 6,520,430 | B2 | * | 2/2003 | Chao | 239/548 |
| 6,568,603 | B2 | * | 5/2003 | Chao | 239/242 |

FOREIGN PATENT DOCUMENTS

| | | | |
|---|---|---|---|
| GB | 2232877 a | * | 10/1991 |
| JP | 10253798 A | * | 9/1998 |

* cited by examiner

*Primary Examiner*—William E. Tapolcai
*Assistant Examiner*—Mohammad M. Ali
(74) *Attorney, Agent, or Firm*—Frank L. Hart

(57) ABSTRACT

The apparatus of this invention has a handle connected to first and second spaced apart spray tubes which are rotatable for passing fluid sprays toward one another or in a common direction outwardly from the apparatus. The handle is connectable to a pressurized fluid source. The apparatus is adapted to decontaminate or clean articles passed between the spray bars and clean articles adjacent the apparatus.

18 Claims, 2 Drawing Sheets

DECONTAMINATION APPARATUS

TECHNICAL FIELD

The subject invention relates to apparatus for decontaminating objects. More particularly, the subject invention relates to apparatus for washing items adjacent the apparatus and washing objects positioned between spray tubes of the apparatus.

BACKGROUND ART

In the washing and decontamination of objects, it often proves most time consuming. Single nozzles connected to a water hose have been used, but they suffer from the disadvantage of not covering a sufficiently large area. Sprays from a nozzle have been used, but they too require continual moving to provide good coverage.

In the art of fire fighting equipment, a further problem exists in trying to efficiently clean all sides of a fire hose after it has been used. One known apparatus utilizes two concentric tubes. Water is supplied to the outside tube, passes through openings in the inside tube and there impinges on a fire hose being pulled through the inside tube. This system is awkward to use, represents a waste of water, and is unnecessarily heavy for a tired fireman to handle.

The present invention is directed to overcome one or more of the heretofore problems, as set forth above.

DISCLOSURE OF THE INVENTION

In one aspect of the invention, a decontamination apparatus has a handle operatively connected to first and second spray tubes and operatively connectable to a pressurized water source.

The handle has first and second end portions and a middle portion. The handle has an opening on said first and portion and first and second spaced apart openings on said second end portion. The openings of the handle are in communication with one another.

The first and second spray tubes each have an axis, first and second end portions and an opening extending therethrough. The spray tube first end portions extend into a respective opening of the handle second end portion and are sealingly connected thereto. The second end portion the spray tubes is sealed.

Each of the spray tubes have a plurality of openings extending linearly along the axis on one side thereof Each of the spray tubes are rotatable between a first position at which the openings are directed toward one another and a second position at which the openings are directed outwardly in common, generally parallel directions.

BEST MODE FOR CARRYING OUT THE INVENTION

Figure 1:
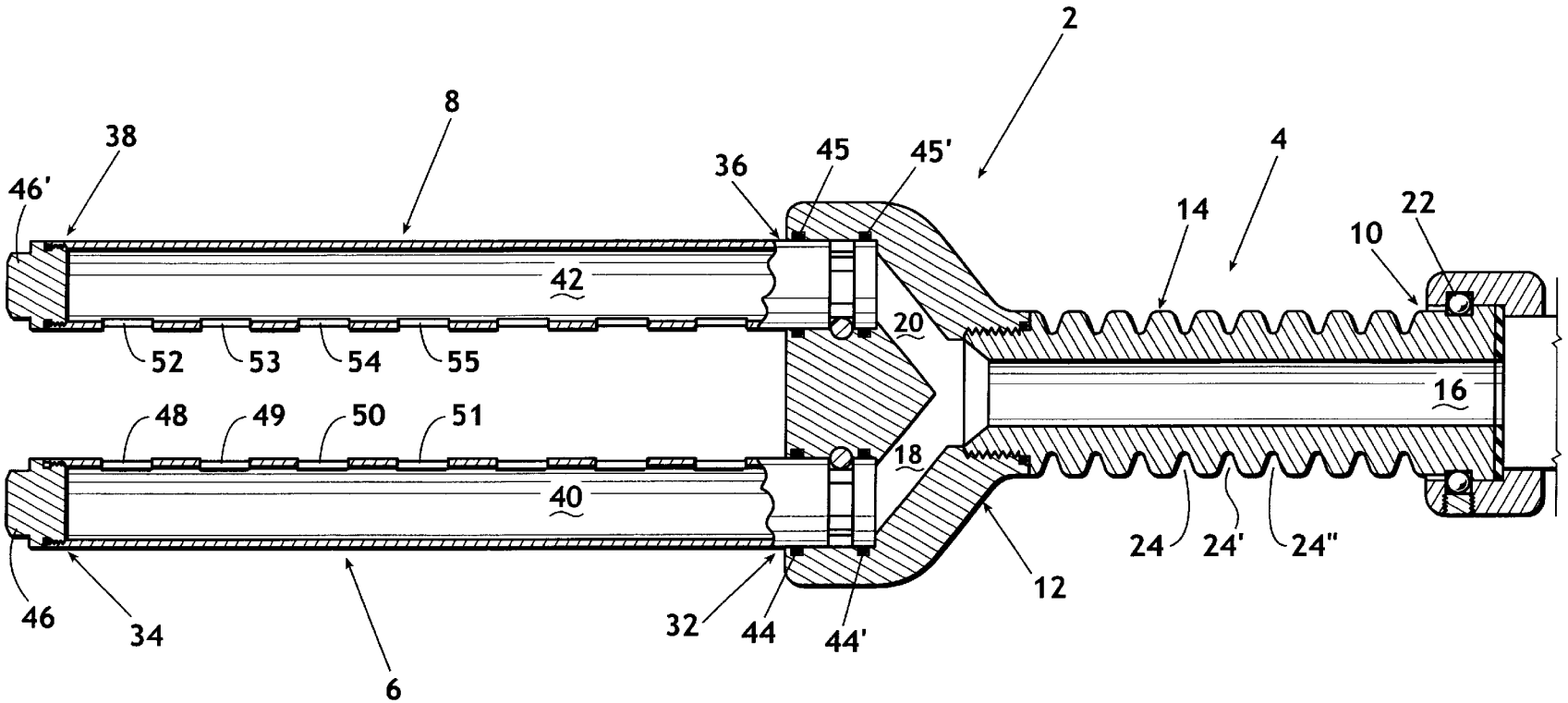
FIG. 1 is a diagrammatic plan view of the apparatus of this invention with the tubes at their first position and FIG. 2 is a diagrammatic plan view is partial section of portions of the apparatus of this invention with the tubes at their second position.
Figure 2:
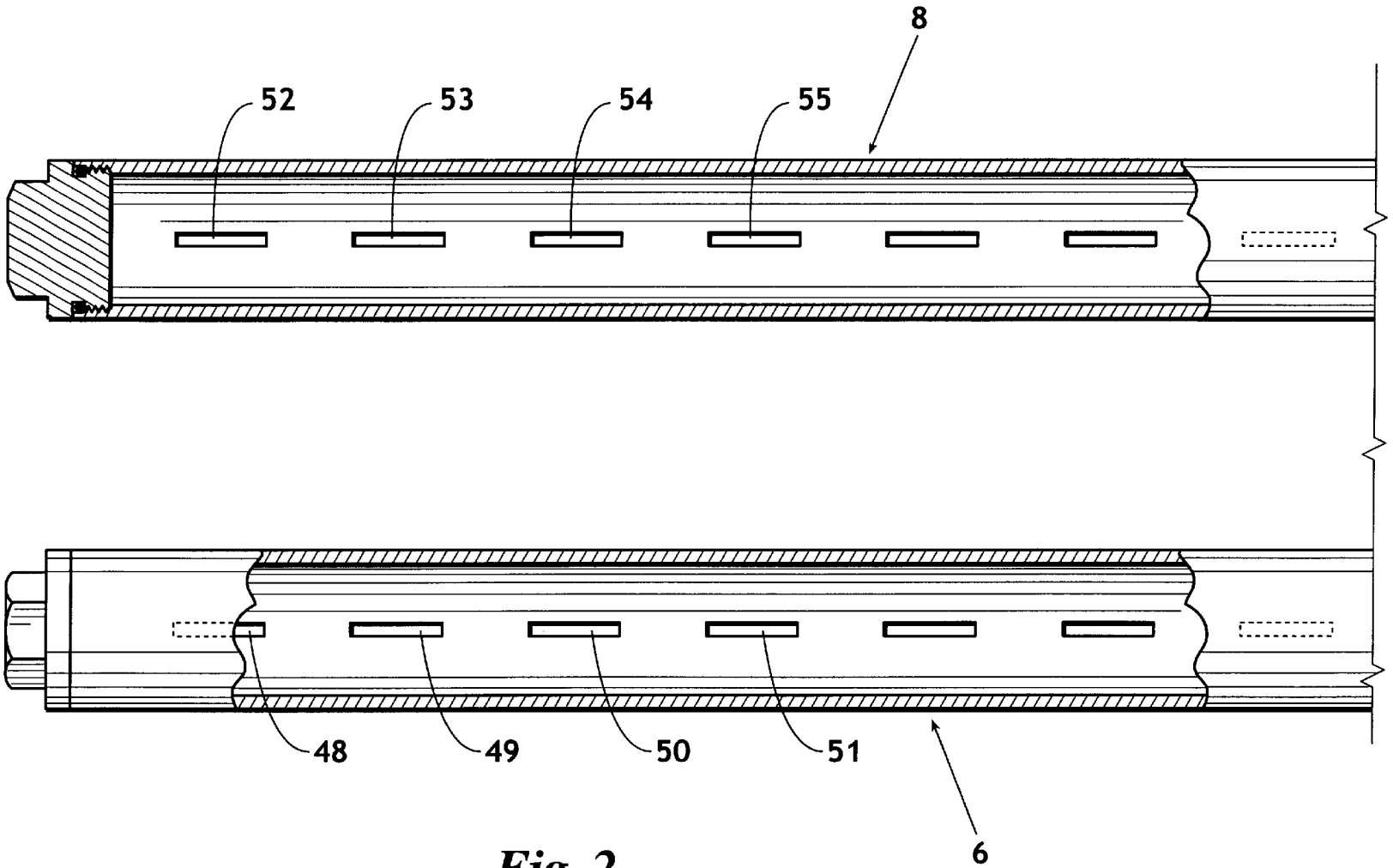

Referring to FIGS. 1 and 2, the decontamination or washing apparatus 2 of this invention has a handle 4 and first and second spray tubes 6,8. By the term "decontamination" as used herein, it is meant the removal of unwanted particles from an object.

The handle 4 has first and second end portions 10,12 and a middle portion 14. The first end portion 10 has an opening 16. The second end portion 12 of the handle 4 has first and second openings 18,20. The openings 16,18,20 are in fluid communication with one another through passageways through the handle 4.

The handle first end portion 10 includes means 22, for connecting handle 4 to a pressure fluid source such as water. Means 22 can be for example, internal threads, external threads, or sealable quick disconnect apparatus, as shown. The first end portion 10 of the handle 4 is preferably adapted to be connectable to a 1 ½ inch hose (not shown). In order to assist an operator to maintain control over the apparatus 2 of this invention when used under high pressure, it is preferred that the middle portion 14 of the handle 4 has a plurality of circumscribing grooves 24,24',24" formed thereon.

The handle 4 can be formed of any material that will withstand pressures of about 250 psi. The handle is preferably formed of metal or organic plastic, more preferably aluminum.

First and second spaced apart generally parallel spray tubes 6,8 each have an axis, respective first and second end portions 32,34 and 36,38 and a respective opening 40,42 extending therethrough. The first end portion 32,36 of the spray tubes 6,8 extend into respective opening 18,20 of the second end portion 12 of the handle 4 and is sealingly connected thereto by an "O" rings 44,44', 45,45'

The second end portion 34,38 of respective spray tubes 6,8 are sealed, preferably by a threaded end caps or plugs 46,46' that can be removed for cleaning debris from within the apparatus 2. It should be understood however that the second end portions 34,38 can be permanently sealed without departing from this invention.

Each of the spray tubes 6,8 have a plurality of respective openings 48–51 and 52–55, for example, extending linearly along their respective tube axis on one side thereof For purposes of simplicity, all of the openings on each of the tubes 6,8 have not been numbered. The openings 48–55 are preferably elongated slots, but can be of circular configuration or be nozzles inserted within the respective openings. The linear length of the group of openings in each respective spray tubes 6,8 has a group length in the range of about 6 inches to about 10 inches. Preferably the group length of each opening group is about 8 inches. The length of the spray tubes 6.8 is in the range of about 6 inches to about 11 inches, preferably about 8 inches. The spray tubes 6,8 are spaced apart in the range of about 2 inches to about 8 inches, preferably about 4 inches.

It should be understood that the ranges of opening group length and overall spray tube length are selected to cover variations in the items to be decontaminated by the apparatus of this invention. At dimensions less than set forth above, the utility of the apparatus will be undesirably limited. At dimensions greater than set forth above, the apparatus will be undesirably more difficult to control and will represent a waste of material, manpower, labor, equipment and natural resources. At the preferred dimensions, the apparatus 2 has been excellently suited for the cleaning of fire hoses in their flattened position.

The spray tubes 6,8 are independently rotatable about their axis between a first position, as shown in FIG. 1, at which the openings 48–55 are directed toward one another and a second position at which the openings 48–55 are directed outwardly in common, generally parallel directions. For example, the first and second spray tubes 6,8 are respectfully rotated about 90 degrees in movement from their first to their second position, as shown in FIG. 2. Example uses can be for cleaning flattened fire hose at the first position and for cleaning the fire truck at their second position.

Since contamination of equipment used for fighting fires is most stubborn to remove, it is preferred that the subject apparatus 2 the constructed to withstand a fluid pressure of about 250 psi. It should be understood that less robust apparatus 2 can be constructed for handling lightly contaminated articles where a common garden hose and house pressure supplies the cleaning fluid.

INDUSTRIAL APPLICABILITY

In the use of the apparatus of this invention, a high pressure fluid source, such as water from a water tank of a fire truck is delivered to the first end portion 10 of the handle 4. The water passes through the handle 4 and into spray tubes 6,8 and exit through openings 48–55 of the spray tubes 6,8.

The spray tubes 6,8 are rotatable between first and second positions. This rotatable feature provides an operator the flexibility of cleaning all surfaces of an article passing between the spray tubes 6,8 at their first position and for cleaning articles positioned adjacent the apparatus 2 in the second position of the spray tubes.

The instant apparatus 2 of this invention was originally designed for cleaning equipment used in fighting fires. However, during development, it was discovered that variations of the variables set forth above provides apparatus that are most adaptable to decontaminating or cleaning articles not used for the fighting of fires.

Other aspects, objects and advantages of this invention can be obtained from a study of the drawings, the disclosure, and the appended claims.

What is claimed is:

1. A decontamination apparatus, comprising:

a handle having first and second end portions and a middle portion and an opening on said first end portion and first and second spaced apart openings on said second end portion, said openings being in communication with one another; and first and second spaced apart generally parallel spray tubes each having an axis, first and second end portions and opening extending therethrough, said spray tube first end portions extending into a respective opening of the handle second end portion and sealingly connected thereto, said second end portion of said spray tube being sealed, each of said spray tubes having a plurality of openings extending linearly along the axis on one side thereof, and each of said spray tubes being rotatable between a first position at which the openings are directed toward one another and a second position at which the openings are directed outwardly in common, generally parallel directions.

2. An apparatus, as set forth in claim 1, wherein the first end portion of the handle includes means for connecting the handle to a pressurized water supply.

3. An apparatus, as set forth in claim 2, wherein the means includes one of internal threads, external threads, and sealable quick disconnect apparatus.

4. An apparatus, as set forth in claim 1, wherein each of the spray tubes has a length in the range of about 6 to about 11 inches.

5. An apparatus, as set forth in claim 4, wherein each of the spray tubes has a length of about 8 inches.

6. An apparatus, as set forth in claim 1, wherein the linear length of the plurality of each opening group in each of the spray tubes is in the range of about 6 to about 10 inches.

7. An apparatus, as set forth in claim 6, wherein the linear length of the plurality of openings in each of the spray tubes is about 8 inches.

8. An apparatus, as set forth in claim 1, including an end cap threadably connectable to and sealing each of the second end portions of the spray tubes.

9. An apparatus, as set forth in claim 1, wherein the first end portion of the handle is adapted to be connected to a 1 ½ inch hose and the total area of the plurality of spray tube openings are adapted to produce a spray having an exit pressure of as least 250 psi.

10. An apparatus, as set forth in claim 1, wherein the middle portion of the handle has a plurality of circumscribing grooves formed thereon.

11. An apparatus, as set forth in claim 1, wherein the handle is formed of organic plastic.

12. An apparatus, as set forth in claim 11, wherein the handle is formed of aluminum.

13. An apparatus, as set forth in claim 1, including at least one "O" ring positioned about each spray tube first end portion and being in forcible contact about a respective opening of the second end portion of the handle and sealing each spray tube to the handle.

14. An apparatus, as set forth in claim 1, wherein the spray tubes are spaced apart a distance in the range of about 2 to about 8 inches.

15. An apparatus, as set forth in claim 1, wherein the spray tubes are spaced apart a distance of about 4 inches.

16. An apparatus, as set forth in claim 1, wherein the spray tube openings are a plurality of slots extending along their respective spray tube axis.

17. A decontamination apparatus, comprising:

a handle having first and second end portions and a middle portion and an opening on said first end portion and first and second spaced apart openings on said second end portion, said openings being in communication with one another;

means for connecting the handle to a pressurized water source; and first and second spaced apart generally parallel spray tubes each having an axis, first and second end portions and opening extending therethrough, said spray tube first end portions extending into a respective opening of the handle second end portion and being sealingly connected thereto, said second end portion of said spray tube being sealed, each of said spray tubes having a plurality of openings extending linearly along the axis on one side thereof, and each of said spray tubes being rotatable between a first position at which the openings are directed toward one another and a second position at which the openings are directed outwardly in common, generally parallel directions, said spray tubes each having a length in the range of about 6 inches to about 11 inches and being spaced apart a distance in the range of about 2 inches to about 8 inches.

18. A decontamination apparatus, comprising:

a handle having first and second end portions and a middle portion and an opening on said first end portion and first and second spaced apart openings on said second end portion, said openings being in communication with one another;

means for connecting the handle to a pressurized fluid source;

first and second spaced apart generally parallel spray tubes each having an axis, first and second end portions and opening extending therethrough, said spray tube first end portions extending into a respective opening of the handle second end portion and being sealingly connected thereto, each of said spray tubes having a plurality of openings in the form of slots extending linearly along the axis on one side thereof, and each of said spray tubes being rotatable between a first position at which the openings are directed toward one another and a second position at which the openings are directed outwardly in common, generally parallel directions, said spray tubes each having a length of about 6 inches and being spaced apart a distance of about 4 inches; and means for removeably sealing the second end portions of each of the spray tubes.

* * * * *